US007649468B2

(12) United States Patent
Gordon

(10) Patent No.: US 7,649,468 B2
(45) Date of Patent: Jan. 19, 2010

(54) SYSTEM FOR DETECTING AN UNDESIRABLE CONDITION AND MANIPULATING AN ELECTRONIC DEVICE

(76) Inventor: Thomas Gordon, 4001 Stoney Hill, Round Rock, TX (US) 78681

( * ) Notice: Subject to any disclaimer, the term of this patent is extended or adjusted under 35 U.S.C. 154(b) by 1215 days.

(21) Appl. No.: 10/844,001

(22) Filed: May 13, 2004

(65) Prior Publication Data

US 2005/0267698 A1 Dec. 1, 2005

(51) Int. Cl.
*G08B 21/00* (2006.01)

(52) U.S. Cl. ..... 340/620; 340/622

(58) Field of Classification Search ..... 340/620, 340/602, 604, 605, 618, 622, 627, 632, 634, 340/600; 204/252, 403.02; 73/40.5 R; 702/85; 307/118

See application file for complete search history.

(56) References Cited

U.S. PATENT DOCUMENTS 4,793,799 A * 12/1988 Goldstein et al. ..... 431/79
5,196,729 A * 3/1993 Thorngren ..... 307/118
5,841,617 A * 11/1998 Watkins et al. ..... 361/106
5,950,573 A * 9/1999 Shellenberger et al. .. 122/448.1
5,992,218 A 11/1999 Tryba
6,025,788 A 2/2000 Diduck
6,036,827 A * 3/2000 Andrews et al. ..... 204/252
6,057,770 A 5/2000 Justesen
6,526,807 B1 * 3/2003 Doumit et al. ..... 73/40.5 R

* cited by examiner

*Primary Examiner*—Van T. Trieu
(74) *Attorney, Agent, or Firm*—Lewis and Roca LLP

(57) ABSTRACT

A system comprising at least one liquid detector that has a cathode and an anode and at least one switching mechanism for receiving a positive voltage from the cathode and anode of a liquid detector. Each switching mechanism comprises at least one switching component that is connected with a power source. Each switching component supplying a current from its connected power source when the switching component is activated. Preferably, each switching component is activated, when the switching component receives a voltage that exceeds a threshold voltage. The system also comprises a base unit that communicates remotely or through direct connection with each switching mechanism. The base unit communicates with at least one application control device that is connected with at least one electronic control apparatus for preventing the undesirable condition. The base unit may also be connected with at least one notification control device that is connected with an electronic notification apparatus for notifying a user that the undesirable condition has been detected. The electronic notification apparatus may comprise a visible light or LED and/or an alarm.

21 Claims, 12 Drawing Sheets

SYSTEM FOR DETECTING AN UNDESIRABLE CONDITION AND MANIPULATING AN ELECTRONIC DEVICE

BACKGROUND OF THE INVENTION

1. Field of the Invention

The invention is directed generally toward systems for detecting the presence of fluids, gas or temperatures. More specifically, the invention is directed toward systems for detecting and signaling the presence of fluids on surfaces, gases in the air, or critical temperatures of the air surrounding fluid-containing apparatuses, and manipulating an electronic device that can notify users and prevent further leakage.

2. Description of Related Art

The controlled flow of liquids and gases plays an important role in many facets of residential and business life. Running water in homes, heating water automatically, dispersing coolants in engines, and mixing reactants in chemical production facilities, all require an ability to facilitate and restrict fluid and gas flow on demand. This is typically accomplished by conducting fluids and gases through pipes and/or hoses to a valve. A valve typically has an "on" position that permits fluids to flow past it freely, and an "off" position that completely prevents fluids or gases from flowing past it. A valve may have other positions that allow fluids to flow past it at varying rates. A valve may be connected to a spigot, burner or other means for the liquid or gas to escape its piping. A series of valves may also be positioned between sections of pipe or between conjoined piping systems for more precise transmission and combination of fluids and gases.

Damage, faulty connections, and natural wear in pipe, hose and valve materials can cause them to leak. Leaks may also be caused by freezing of pipes and hoses. Leaks disrupt control over the transfer of fluids and gases, and fluids that escape through the leaks can further damage the pipe and valve materials, as well as surrounding objects. Water leaks and gas leaks can also cause health risks and fire hazards. Only quick detection of leaks can enable a person to prevent such consequences, but leaks in pipes or valves that are concealed from view may not become apparent until some damage is already done. As a result, sensing devices have been invented to aid in detecting a leak and to restrict the flow of liquid toward the leak, thereby minimizing damage.

Past inventions have attempted to provide alarm systems for signaling the presence of water or other liquids at an undesired site. For example, U.S. Pat. No. 4,890,485 to Hsu discloses a housing that encloses an absorbent material. When enough liquid is present, the material expands and pushes a wire through a hollow rod to produce an alarm. U.S. Pat. No. 4,227,190 to Kelley, et al., discloses sensors positioned on the bottom surface of a housing, which is mounted on the bottom of a standpipe. When liquid on a floor reaches a sufficient depth to contact the sensors, an alarm is sounded. While inventions such as these provide detection and notification of leaking fluids, they require a significant amount of leakage to occur before activating an alarm. The amount of fluid that may be released from its piping or other source before reaching the housings in either of these inventions may cause severe damage before the alarm is sounded. Additionally, neither invention provides a means for stopping the leak by shutting off valves that allow fluid to flow towards the leak. This may be problematic where the leak detectors are out of a user's audible range.

Other devices have been invented to detect moisture through the use of electrical potential and conductivity. For example, U.S. Pat. No. 4,325,060 to Purtell, et al., discloses a buoyant housing that has an anode and cathode on its bottom surface. When enough water or other conductive liquid contacts the electrodes to cause the housing to float, a circuit is completed that causes an alarm to sound. U.S. Pat. No. 3,771,349 to Yatabe discloses a device that uses the electrical potentials of dissimilar metals to detect changes in air humidity. Ambient conditions are measured and used as a baseline and compared to areas where leaks might occur, which would typically have higher levels of humidity in the surrounding air. A sample of the air must be drawn into an apparatus in order to test changes in air humidity. While these inventions provide a more sophisticated means of detecting the presence of electrically conductive liquids, they also require a significant amount of liquid to have been leaked into the area before conductivity is achieved by the device. Additionally, while these devices also alert users to the present of undesired liquids, Yatabe lacks the ability to function automatically and neither prevent further leakage.

There are devices which provide shut-off capabilities to prevent fluid flow, upon detection of leaks. U.S. Pat. No. 4,805,662 to Moody uses a solenoid valve that is held open by an electrical current. A second circuit is place within a water collector, such that when water leaking out of a hot water heater collects in the collector, it shorts the second circuit and trips a breaker. This interrupts the current holding the valve open and the valve is closed. U.S. Pat. No. 6,057,770 to Justesen, and U.S. Pat. No. 5,992,218 to Tryba, also work on power interruption principles, but also shut off the gas to the water heater and power to an appliance using water.

U.S. Pat. No. 5,632,302 to Lenoir, Jr., takes the opposite approach. The solenoid valve is disposed in an open position and is only closed if current reaches it. A commercially available water sensor is used to detect leaking water and sends an electrical signal to a power supply. The power supply provides enough electrical current to hold the solenoid valve closed. These devices also include audible and visible indicators that the valve to the water heater has been closed. Though these devices are presumably effective, they are applicable only to detect water leaking from specific appliances. Additionally, the appliances for which these devices are used are typically out of sight, such as water heaters, or their connections to water sources are not easily observable, such as with dishwashers. An alarm or light that indicates a leak may not be heard or seen by persons in normally-trafficked areas of a house or building without excessive noise. More significantly, these devices are not applicable to individual sections of pipe or hose, which are underground or whose sources are controlled by valves at a significant distance from the areas being monitored for leaks.

Subsequent inventions provide remote indication of leaking water. U.S. Pat. No. 5,967,171 to Dwyer, and U.S. Pat. No. 6,025,788 to Diduck, provide radio transmission of signals from water detection means to motorized actuators connected to valves. However, they disclose specific water detection means that are not widely applicable. The Dwyer invention utilizes specific hoses and floor pieces that are designed to maintain a certain level of electrical resistance. When their resistances change due to leaking or contact with water, power is cut to the valves controlling the flow of water and to the appliance using the water. This water detection means is highly specialized and not susceptible of many applications. The Diduck invention uses water-sensing tape that contains tiny apertures through which water may contact a wire. Contact between the wire and water causes a low-voltage electrical short that causes a signal to be sent to a remote actuator that closes the appropriate valve. This type of water sensor may be tripped by small amounts of manually spilled water and even high humidity, making it less reliable than other water sensing means. Additionally, the invention does not notify persons of a leak, particularly those out of visible or audible range.

Hence, there is a great need in the art for a detection system that reliably detects small amounts of liquid or gas, or critical temperatures, which can inform a remote device that such condition has been detected, which can notify a user even if the user is out of visible or audible range, which can reverse a valve position or other device, and which is susceptible of a number of applications and sensitivities without the need for additional iterations of the system's components. Preferably, the system uses switches dependent upon the receipt of threshold voltages, avoiding the dangers of electrical shorts or power interruptions.

SUMMARY OF THE INVENTION

The current invention provides a detection system that reliably detects small amounts of liquid or gas, or critical temperatures, which can inform a remote device that such condition has been detected, which can notify a user even if the user is out of visible or audible range, which can reverse a valve position or other device, and which is susceptible of a number of applications and sensitivities without the need for additional iterations of the system's components. The system uses switches dependent upon the receipt of threshold voltages, avoiding the dangers of electrical shorts or power interruptions.

The system comprises at least one liquid detector that has a cathode and an anode and at least one switching mechanism for receiving a positive voltage from the cathode and anode of a liquid detector. Each switching mechanism comprises at least one switching component that is connected with a power source. Each switching component supplying a current from its connected power source when the switching component is activated. Each switching component may comprise a switching transistor, a voltage comparator, an operational amplifier, a thyristor, or a field-effect transistor. Preferably, each switching component is activated, when the switching component receives a voltage that exceeds a threshold voltage. The threshold voltage may be zero volts or greater than zero volts, depending upon the type of switching component used.

The system also comprises a base unit that communicates remotely or through direct connection with each switching mechanism. The base unit communicates with at least one application control device that is connected with at least one electronic control apparatus for preventing the undesirable condition. Examples of electronic control apparatus include electronic valves and appliance ON/OFF switches. The base unit may also be connected with at least one notification control device that is connected with an electronic notification apparatus for notifying a user that the undesirable condition has been detected. Examples of notification control devices include an autodialer working with a telephone as the electronic notification apparatus. The electronic notification apparatus may also comprise a computing device that receives instructions to transmit text messages to an agent. The electronic notification apparatus may also be a simpler apparatus integrated with the base unit, such as a light, a light-emitting diode, or an alarm.

DETAILED DESCRIPTION

Figure 1A:
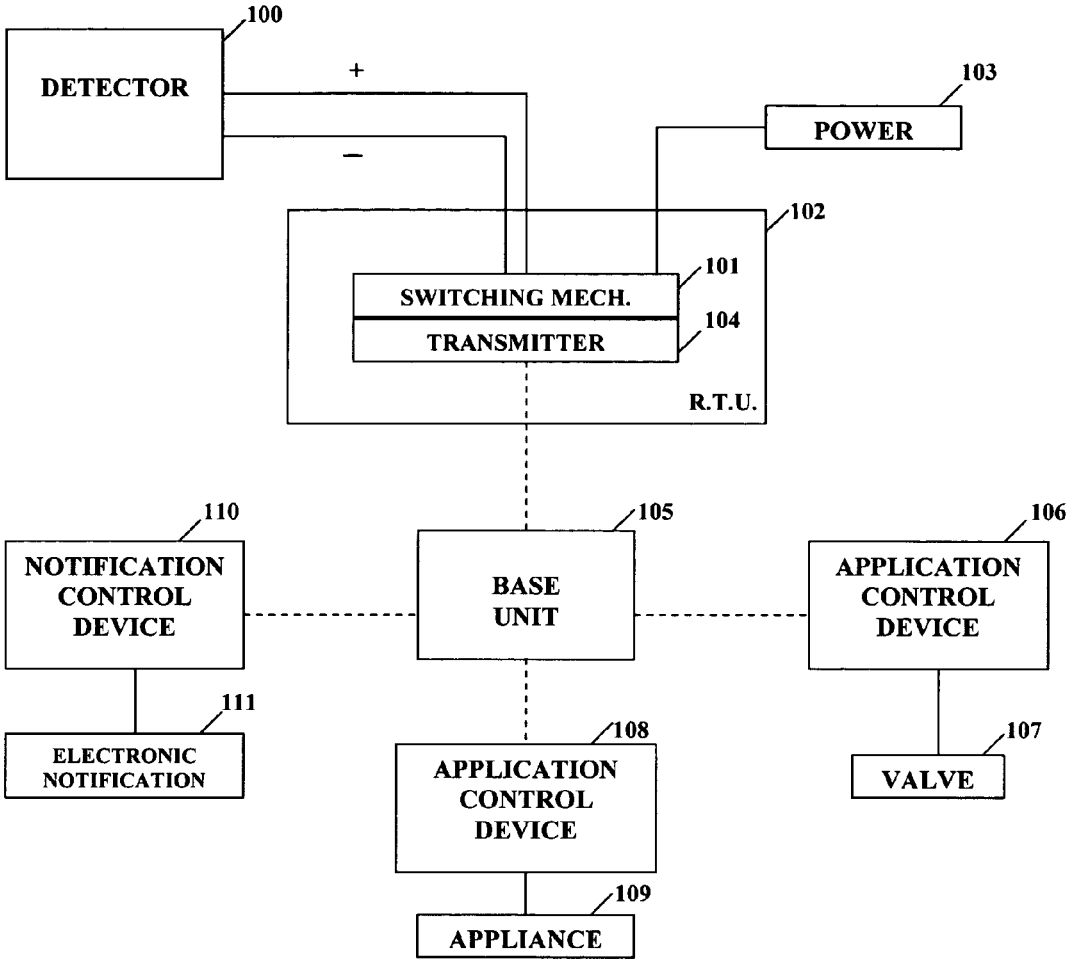
FIG. 1A is a block diagram illustrating the component devices that comprise one embodiment of the current invention.

Referring now to the figures, wherein like features are designated by like numerals, the invention is directed to a system for detecting an undesirable condition and manipulating an electronic device. FIG. 1A illustrates the component devices of one embodiment of the current invention. The invention comprises a detector 100 having a cathode and anode. Detector 100 may comprise a leak detector pad having a cathode and anode that form a galvanic cell when in contact with a polar liquid. The leak detector pad can be placed in any location that may come in contact with a polar liquid, including on floors, walls, ceilings, pipes, hoses, tubes and the like. It may also be placed out of doors (where rain or irrigation water doesn't pool or come in contact with the electrodes, and where standing water doesn't exist and where soil remains relatively dry, etc.). It may also be placed in areas where liquids other than water are to be detected, such as acids, coolants and other chemicals. The leak detector pad may also be used as a float indicator, as described with reference to FIG. 10.

Detector 100 may alternatively comprise a gas detector that supplies current from a power source, such as a battery, whenever a threshold quantity of natural gas is detected in the air surrounding detector 100. Detector 100 may alternatively comprise a thermocouple device that supplies current from a power source, when it detects that the air temperature surrounding a pipe or other device containing fluid is within a pre-defined or user-defined range of the freezing point of the fluid. The thermocouple and gas detection devices may comprise commercially sold devices known to those skilled in the art.

The cathode and anode of detector 100 are each connected with a switching mechanism 101. Switching mechanism 101 comprises at least one transistor, silicon-controlled rectifier (thyristor), operational amplifier, voltage comparator, field effect transistor (FET), or other switching component that allows usable current from a power source 103 to flow through it and drive other circuitry, when its threshold voltage is met or exceeded. The threshold voltage can be a positive voltage, for example, when a transistor is used. The threshold voltage can alternatively be 0V, for example, where an operational amplifier or voltage comparator referenced to ground is used. Preferably, switching mechanism 101 comprises at least one transistor or voltage comparator. In the preferred embodiment of the invention, at least one transistor is used.

In circumstances where a leak detection pad is used, switching mechanism 101 must provide greater sensitivity than that provided by a single transistor or comparable component, when (other variables being constant) the sizes of the electrodes on a leak detector pad decrease; as spacing between the electrodes on a leak detector pad increases; as the polarity of a liquid to be detected decreases or its state more closely approaches pure vapor. For thermocouple and gas detection devices, a power source is used on the device itself. It is therefore preferable that these detectors have their own sensitivity controls. Those skilled in the art will appreciate other factors that affect the need for greater sensitivity.

Greater sensitivity in switching mechanism 101 may be achieved by using additional switching components cascaded with a first-stage component. Two or more switching components may operate using a single power source, or one or more switching components may have its own power source. Where enhanced sensitivity is required, it is preferable that two transistors are cascaded to provide selectable sensitivity in switching mechanism 101, without excessive sensitivity.

The sensitivity of switching mechanism 101 may be made selectable by a user. In the embodiment described with reference to FIG. 5, separate inputs are used, such that the switching mechanism 101 is made more sensitive when the cathode and anode of detector 100 are connected with a first set of inputs, and less sensitive when connected with a second set of inputs. In the embodiment described with reference to FIG. 6A, a variable resistor or potentiometer may be placed within the path between a first-stage transistor and a second-stage transistor of switching mechanism 101, such that a user may select the amount of current that is used to drive the load for the circuit.

In the preferred embodiment described with reference to FIG. 6B, a circuit containing a variable resistor or potentiometer is placed in the path connecting the cathode to a first-stage transistor, such that a user may select the strength of current required to turn on the first-stage switching transistor.

The various embodiments of switching mechanism 101 are described in further detail below.

In the embodiment shown in FIG. 1A, switching mechanism 101 is an element of a remote transmission unit (R.T.U.) 102, which comprises switching mechanism 101 and a transmitter 104 and which connects with at least one power source 103. Power source 103 may comprise a transformer plugged into an electrical outlet, or it may comprise a battery. Alternatively, multiple power sources may be used, wherein a transformer is the primary power source and a battery acts as a back-up in case of a power outage. The elements of R.T.U. 102 may be enclosed in a single housing.

When the cathode and anode of detector 100 produce a voltage that meets or exceeds the threshold voltage of a switching component used in switching mechanism 101, the component then enables current from power source 103 to drive transmitter 104. Transmitter 104 then communicates a signal to a base unit 105. Transmitter 104 may communicate with base unit 105 via radio, or other appropriate signals known to those skilled in the art. Preferably, transmitter 104 uses a signal type that will not exhibit interference with other household remote systems, such as electronics or telephone equipment. Transmitter 104 may use coded signals, such as 'rolling code,' 'billion code,' or even coding systems as typically found in older automatic garage door openers such as the 9 or 12 pin DIP switch code options. In the preferred embodiment of the invention, transmitter 104 uses a 12-pin DIP switch code system.

Between switching mechanism 101 and transmitter 104 can be other circuits such as 'one-shot circuits' that can be made to activate transmitter 104 for a certain amount of time and 'pulse generators' that can pulse transmitter 104, or a combination of the two that would then pulse transmitter 104 for a limited amount of time. Where power source 103 comprises one or more batteries, this can ensure transmission of the signal by transmitter 104 without draining the batteries at a high rate.

The communication of a signal from transmitter 104 to base unit 105 indicates that a liquid, gas or critical temperature has been detected by detector 100. Base unit 105 then communicates with one or more application control devices that manipulate their associated devices. In the embodiment shown in FIG. 1A, base unit 105 comprises at least one power source, a means for receiving signals from R.T.U. 102; control logic or other means for determining that a signal should be sent to one or more application control devices; and a means for transmitting signals with one or more application devices. The R.T.U. 102 and the base unit 105 may also contain an integrated alarm or indicator light for notifying persons within audible or visible range of R.T.U. 102 or base unit 105 that a liquid, gas or critical temperature has been detected by detector 100. Base unit 105 may comprise a portable device having a battery power source or a stationary device or wall-mounted device receiving power from a transformer that plugs into a wall outlet or from a battery, or from a transformer with a battery back-up. Base unit 105 is described further below.

Application control devices 106 and 108 comprise electronic devices capable of receiving signals from base unit 105 and controlling electronic apparatuses accordingly. Application control devices 106 and 108 may comprise elements of the electronic apparatuses they control, or they may comprise separate devices electrically connected with the electronic apparatuses they control. Application control devices 106 and 108 may be connected with base unit 105, or they may receive remote signals from base unit 105. Where only one application control device is used, or where all application control devices are located near each other, base unit 105 is preferably connected with the application control device(s). Where many remote application control devices are used, base unit 105 preferably communicates remotely with them.

FIG. 1A shows three examples of devices that may be controlled by application control devices 106 and 108. For instance, application control device 106 controls at least one electronically-operated valve 107 that allows liquid or gas to flow to the source of a potential leak. When base unit 105 receives a signal that detector 100 has detected a liquid or gas leak, it instructs application control device 106 to reverse the position of at least one valve 107, shutting off the flow of liquid or gas to the source of the potential leak. Note that valve 107 may also control the flow of other materials. For instance, where application control device 106 shuts off the flow of liquid to a heating device, such as a water heater or reaction vessel, the same or a different application control device may shut off a valve that allows the flow of propane or another heating source, thereby preventing damage to the heater or other vessel.

In some instances, a valve controlling the flow of liquid to an appliance 109 may be in a closed position by default. In such instances, activation of appliance 109 causes the valve to open, allowing fluid to flow. In these instances, base unit 105 may communicate with application control device 108, which deactivates appliance 109. As described above, application control device 108 may comprise a circuit or other element of appliance 109, or it may be a separate device connected with appliance 109. In other instances, where a critical temperature is detected, it may be desirable to open a closed valve. For instance, where detector 100 comprises a thermocouple device that detects a temperature within a user-defined range of the freezing temperature of a liquid passing through a pipe, the base unit 105 may signal an application control device 107 to open a valve and allow fluid flow, thereby preventing freezing. When a warmer temperature is detected, the valve may then be closed again.

Notification control device 110 comprises an electronic device capable of receiving signals from base unit 105 and controlling notification apparatuses accordingly. Notification control device 110 may comprise one or more elements of the notification apparatus it controls, or it may comprise a separate device electrically connected with the notification apparatus it controls. Notification control device 110 may be connected with base unit 105, or it may receive remote signals from base unit 105. Where only one notification control device is used, or where multiple notification control devices are located near each other, base unit 105 is preferably connected with the notification control device(s). Where many remote notification control devices are used, base unit 105 preferably communicates remotely with them.

Notification control device 110 communicates with at least one electronic notification apparatus 111 that communicates the detection of a leak or critical temperature to remote agents. For instance, notification control device 110 may comprise an autodialer and electronic notification apparatus 111 a telephone. When notification control device 110 receives a signal from base unit 105, it communicates a signal or message via the telephone to an individual, such as a residence owner via cell phone, pager or similar device, or to a call center of agents who dispatch repair persons to check the status of and/or repair detected leaks. Electronic notification apparatus 111 may also comprise a computing device that sends an e-mail or similar message to an individual or agent by computer, handheld media device, or similar device. Electronic notification device 111 may also comprise a remote alarm or lighting system for persons not in audible or visible range of any alarm integrated with base unit 105. Those skilled in the art will appreciate other notification devices that may be used without departing from the scope of the current invention.

Figure 1B:
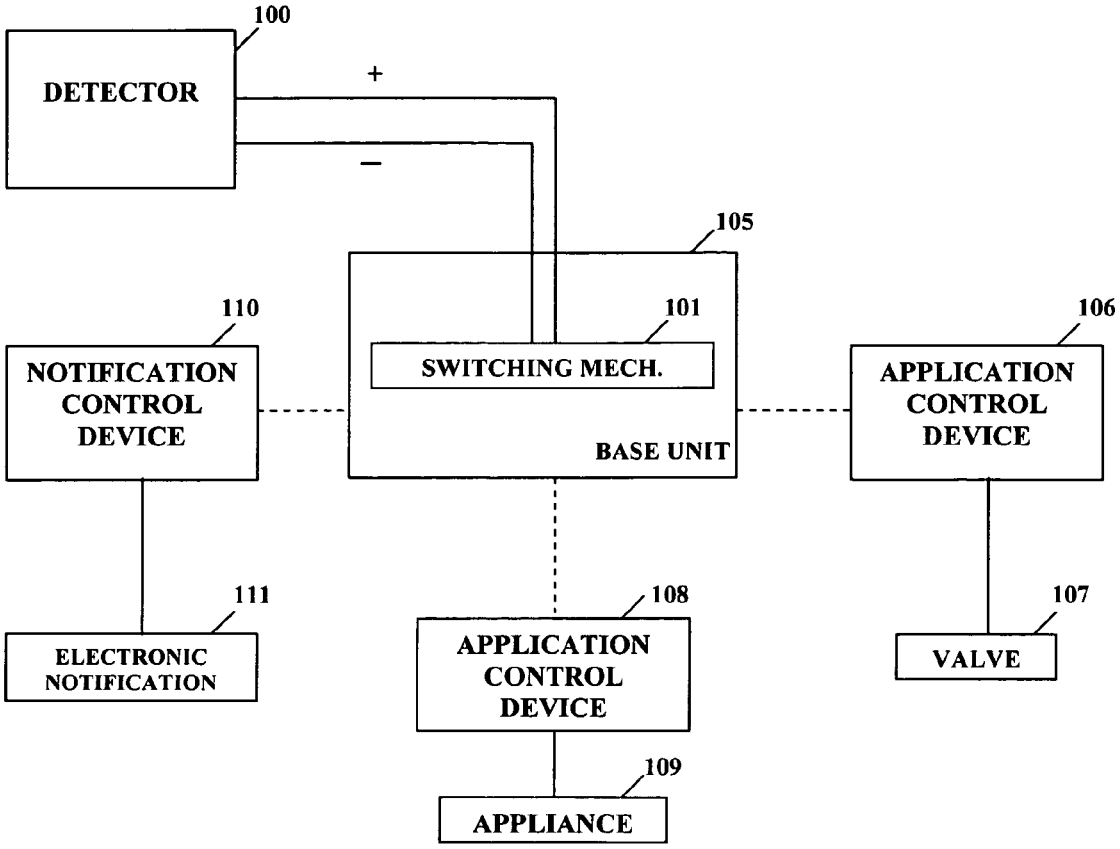
FIG. 1B is a block diagram illustrating the component devices that comprise a second embodiment of the current invention.

FIG. 1B is a block diagram illustrating a second embodiment of the current invention. In this embodiment, switching mechanism 101 is integrated with base unit 105. Detector 100 connects directly to base unit 105, eliminating the need for the R.T.U. and power source described with reference to FIG. 1A. In the embodiment shown in FIG. 1B, switching mechanism 101 allows for current from the power source of base unit 105 to drive base unit 105 when the threshold voltage of the switching component of switching mechanism 101 is met or exceeded by voltage produced by the cathode and anode of detector 100. Where switching mechanism 101 has more than one components, sensitivity may be controlled in any of the manners described above.

The elements illustrated in FIG. 1A and FIG. 1B are described in further detail with reference to the following figures.

Figure 2:
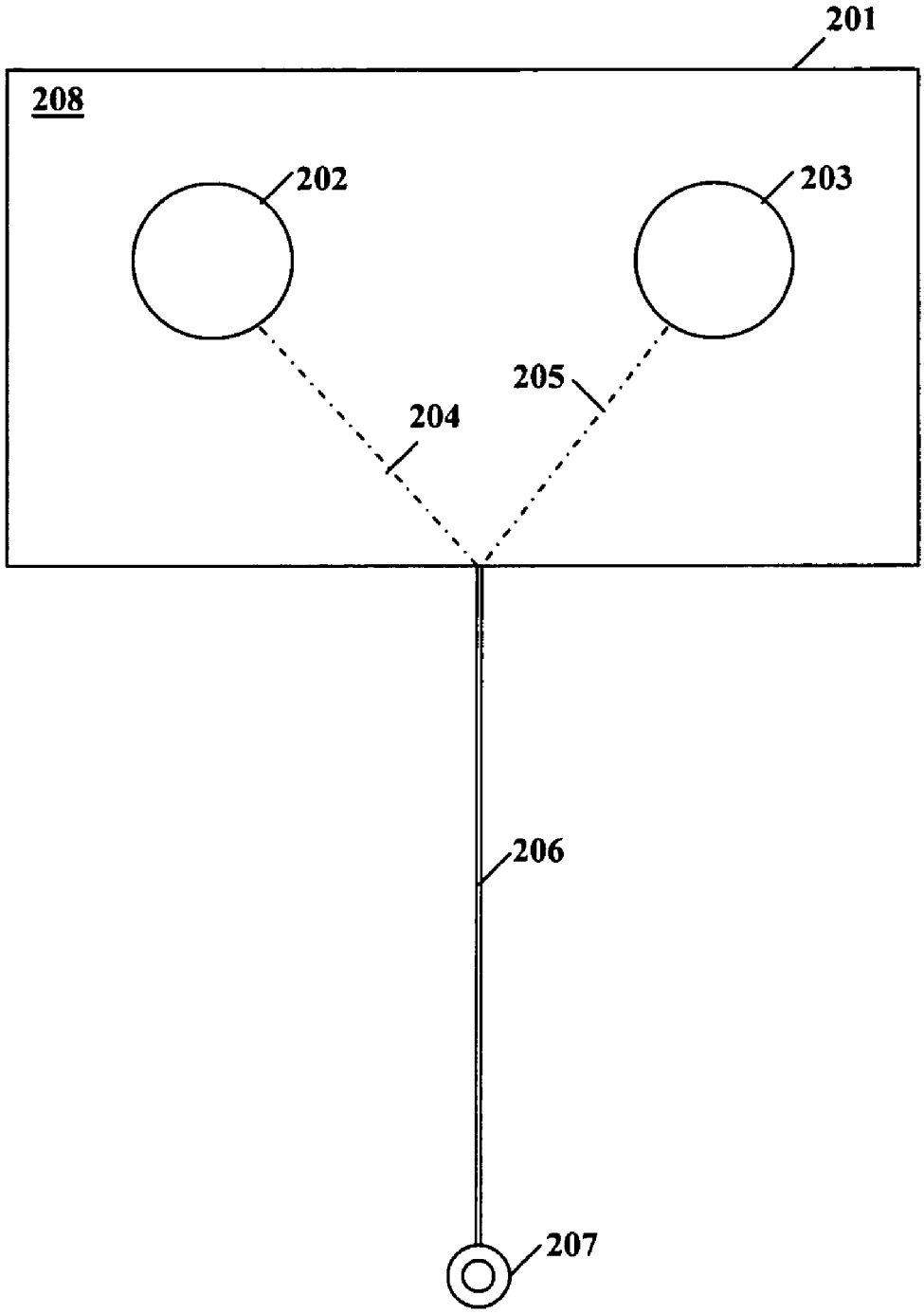
FIG. 2 is a pictorial diagram illustrating a perspective view of a top or bottom surface of a leak detection pad.

FIG. 2 illustrates a leak detector pad having a housing 201. Housing 201 may be formed of rubber, plastic or other durable, non-absorbent, and electrically non-conductive material. Though housing 201 is shown in FIG. 1 to be a rectangular panel, it may comprise a narrow strip, a circular pad or other suitable shape. Housing 201 may have a border of greater thickness than its interior 208, such that when housing 201 lies flat on a surface, the interior 208 is raised slightly above the surface. Housing 201 may also have feet positioned at positions that accomplish a similar purpose.

Housing 201 surrounds at least one pair of electrodes. Each pair of electrodes comprises a cathode 202 and an anode 203 positioned such that they are not in contact with each other. Those skilled in the art will appreciate that the positions of the two electrodes may be reversed or otherwise manipulated without departing from the scope of the invention. The electrodes comprise two dissimilar metals that form a galvanic cell, when both electrodes are in contact with a polar liquid. Each electrode is preferably the size of a penny, though they may be larger or smaller, as described previously. The surface of each electrode may be exposed on one side of interior 208, or they may be exposed on both sides of interior 208.

Each electrode comprises a substantially non-reactive, nontoxic material. Preferably, the electrodes also comprise materials that are durable, corrode at slow rates, and do not form a stable film of oxidation. The combination of metals used for cathode 202 and anode 203 preferably gives rise to a cell potential that exceeds 0.6 Volts in the presence of tap water, such that typical switching transistors may be used unless less polar liquids need to be detected. Cathode 202 may comprise copper, stainless steel, or other suitable metals known to those skilled in the art. If the liquid to be detected is highly corrosive, cathode 202 may comprise platinum, gold, silver or other suitable metal that is highly-resistant to corrosion. In the absence of highly-corrosive liquids, cathode 202 preferably comprises copper. Anode 203 may comprise zinc, lead, aluminum, copper, stainless steel, or other suitable metal known to those skilled in the art. If the liquid to be detected is highly corrosive, anode 203 may comprise silver or other suitable metal that is highly-resistant to corrosion. In the absence of highly corrosive liquids, anode 203 preferably comprises zinc.

Wires 204 and 205 are connected with the electrodes and may extend through parallel lengths of insulation 206 to connect with a R.T.U. or base unit, as described with reference to FIGS. 1A and 1B. Wires 204 and 205 may connect directly with circuitry of the transmitter or base unit, or they may connect with an output jack 207, which connects with an input jack of the transmitter or base unit, as described previously. It should be noted that housing 201 is not necessary, as the cathode 202 and anode 203 can be attached directly to any surface that may become wet. This includes hoses and pipes. Insulating material that is also tacky can be applied to one surface of electrodes 202 and 203 with electrodes 202 and 203 then attached to the desired item or place that requires monitoring.

Figure 3:
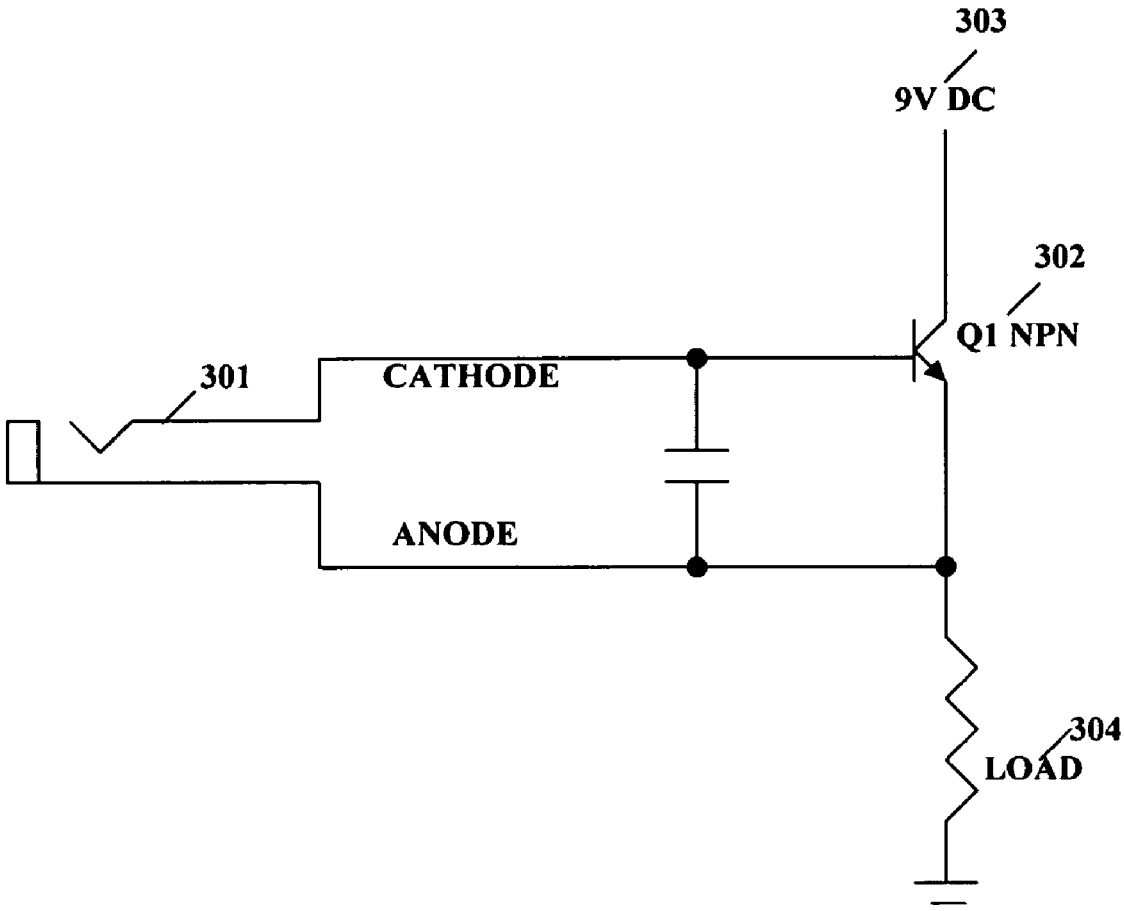
FIG. 3 is a circuit diagram illustrating one embodiment of the switching mechanism shown in FIG. 1A and FIG. 1B.
Figure 4:
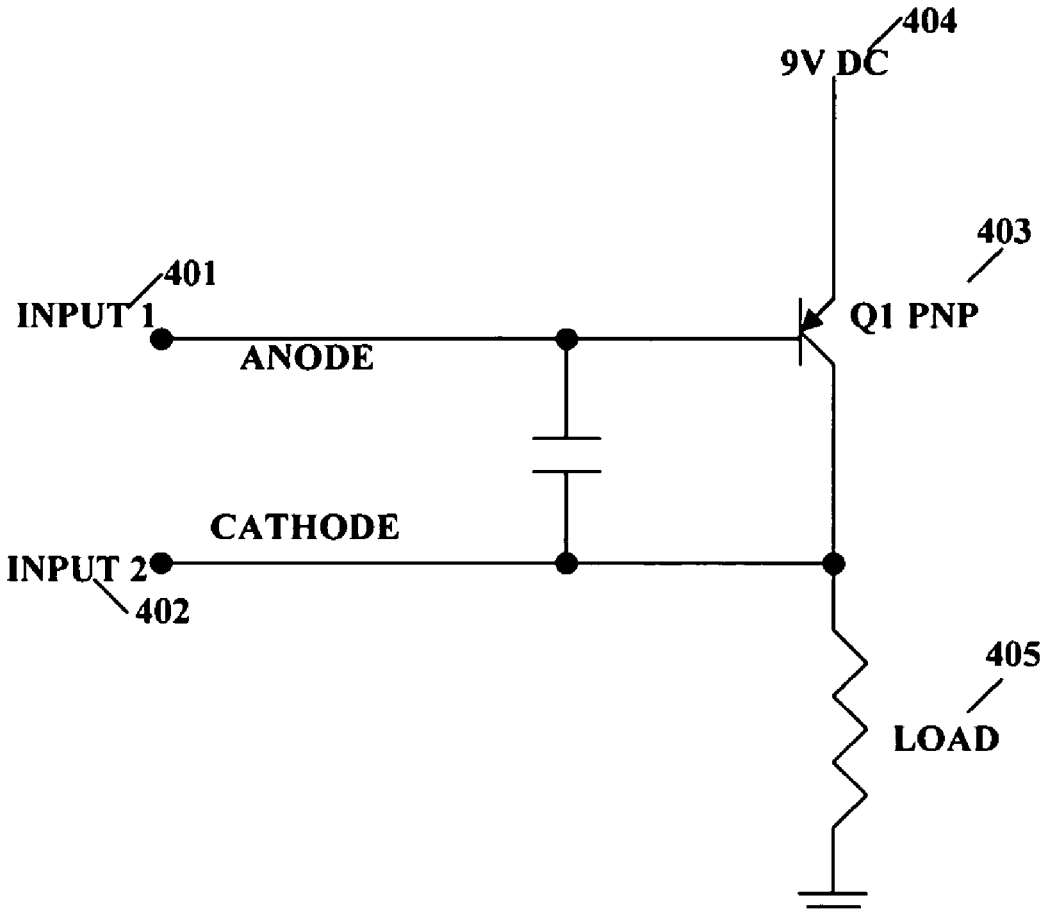
FIG. 4 is a circuit diagram illustrating a second embodiment of the switching mechanism shown in FIG. 1A and FIG. 1B.

FIGS. 3 and 4 illustrate embodiments of a circuit that acts as the first-stage switching component of the switching mechanism described with reference to FIGS. 1A and 1B. FIG. 3 illustrates a first-stage switching component employing a NPN transistor and an input jack. In this embodiment, the output jack shown in FIG. 2 is connected with an input jack 301, such that the cathode of a detector is connected with the base of a NPN transistor (Q1) 302 and the anode is connected with the emitter of the transistor 302. The collector of the transistor is connected with a source of electric current 303, such as a 9 Volt battery. When the threshold voltage of transistor 302 is met or exceeded by current from the cathode and anode of the detector, current from current source 303 flows across the transistor to drive a load 304, such as one or more circuits of a transmitter or base unit, as described above.

FIG. 4 illustrates a first-stage switching component employing a PNP transistor without an input jack. In this embodiment, the anode is connected with the base of a PNP transistor 403 via a first input terminal 401 and the cathode is connected with the collector of the transistor 403 via a second input terminal 402. The emitter of transistor 403 is connected with a source of electric current 404, such as a 9 Volt battery. When the threshold voltage of transistor 403 is met or exceeded by current from the cathode and anode, current from current source 404 flows across transistor 403 to drive a load 405, such as one or more circuits of a transmitter or base unit, as described above.

Figure 5:
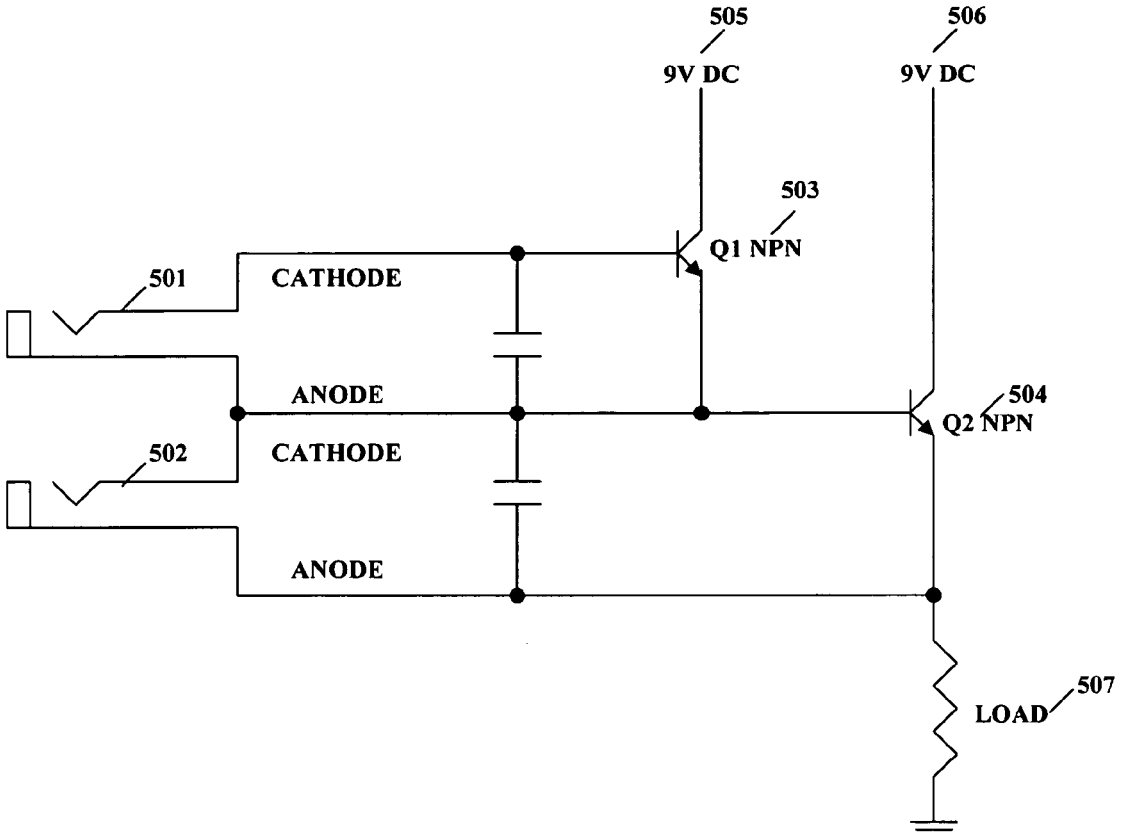
FIG. 5 is a circuit diagram illustrating a third embodiment of the switching mechanism shown in FIG. 1A and FIG. 1B.

FIG. 5 is a circuit diagram illustrating a switching mechanism with variable sensitivity. This embodiment of the switching mechanism utilizes two cascaded NPN transistors and separate input jacks for allowing a user to select the sensitivity of the switching mechanism. By connecting a detector with a first input jack 501, the cathode of the detector is connected with the base of a first-stage NPN transistor (Q1) 503 and the anode with the emitter of the first-stage NPN transmitter (Q1) 503. When the threshold voltage of first-stage transistor 503 is met or exceeded by current from the cathode and anode of the detector, first-stage transistor 503 allows current from a first source 505 to flow to a second-stage transistor (Q2) 504. Once the threshold voltage of second-stage transistor 504 is met or exceeded by current from first power source 505, second-stage transistor 504 allows current to flow from the same power source, or from a second power source 506, to drive a load 507, such as one or more circuits of a transmitter or base unit. Note that first power source 505 and second power source 506 are used for clarity of explanation. In accordance with the description of FIG. 1, the first and second power sources may refer to the same power source.

Alternatively, a user may connect the detector with a second input jack 502, such that the cathode of the detector is connected with the base of second-stage transistor 504 and the anode with the emitter of second-stage transistor 504. In this way, second-stage transistor 504 becomes the only switching component used by the switching mechanism. When the threshold voltage of second-stage transistor 504 is met or exceeded by current from the cathode and anode of the detector, second-stage transistor 504 allows current to flow from second power source 506 to drive load 507, such as one or more circuits of a transmitter or base unit.

In the embodiment shown in FIG. 5, first input jack 501 imparts greater sensitivity to the switching mechanism. First-stage transistor 503 is cascaded with second-stage transistor 504 to drive a larger current load when the two operate in tandem. Second input jack 502 imparts less sensitivity to the switching mechanism. Second-stage transistor 504 is not cascaded with first-stage transistor 504, such that, where a leak detector pad is used, humidity, vapors, and liquids less polar than the liquid to be detected may be ignored. This allows the user to shift sensitivity without using separate switching mechanisms.

Figure 6A:
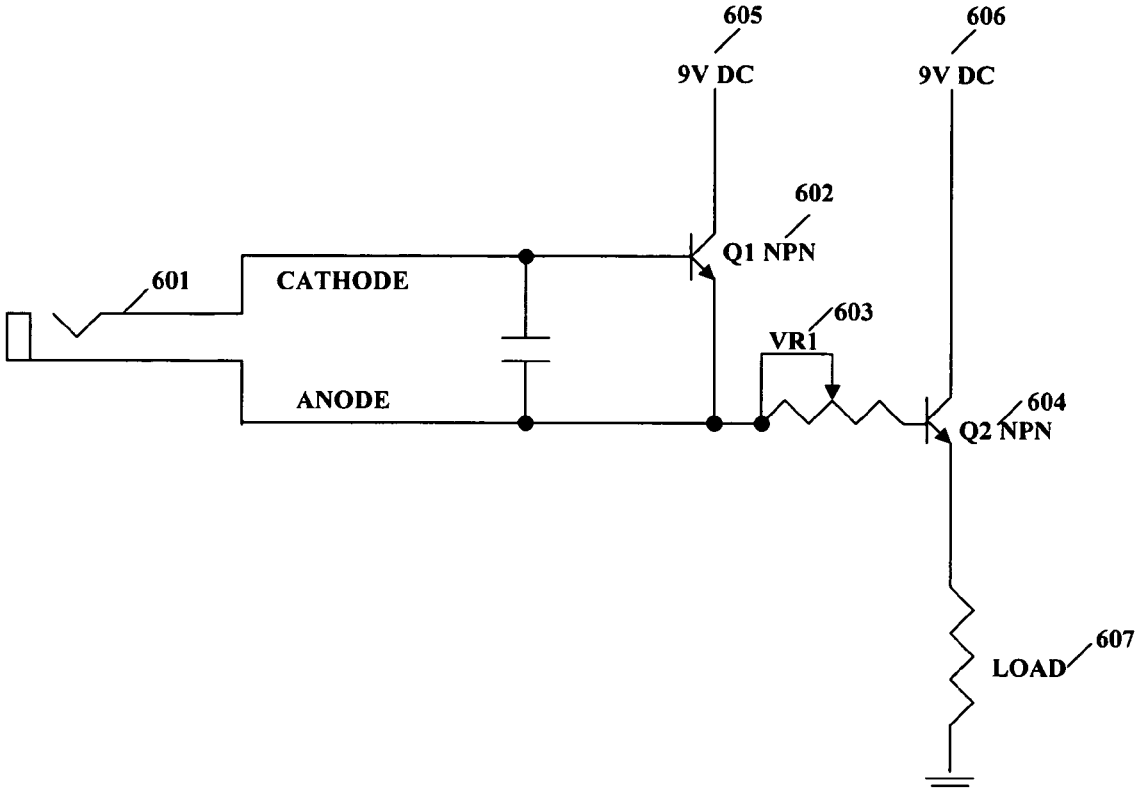
FIG. 6A is a circuit diagram illustrating a fourth embodiment of the switching mechanism shown in FIG. 1A and FIG. 1B.

FIG. 6A is a circuit diagram also illustrating a switching mechanism with variable sensitivity. This embodiment of the switching mechanism utilizes two cascaded NPN transistors and a potentiometer for allowing a user to select the sensitivity of the switching mechanism. By connecting a detector with an input jack 601, the cathode of the detector is connected with the base of a first-stage NPN transistor (Q1) 602 and the anode with the emitter of the first-stage NPN transmitter (Q1) 602. When the threshold voltage of first-stage transistor 602 is met or exceeded by current from the cathode and anode of the detector, first-stage transistor 602 allows current from a first source 605 to flow to a second-stage transistor (Q2) 604. Once the threshold voltage of second-stage transistor 604 is met or exceeded by current from first power source 605, second-stage transistor 604 allows current to flow from a second power source 606 to drive a load 607, such as one or more circuits of a transmitter or base unit. Note that the first and second power sources, as in FIG. 1 and FIG. 5, may refer to the same power source.

In the embodiment shown in FIG. 6A, a user may adjust a potentiometer (VR1) 603 that varies the resistance along the path from first-stage transistor 602 to second-stage transistor 604. Potentiometer 603 limits the current that flows from first-stage transistor 602 to second-stage transistor 604. As resistance is decreased, more current from first power source 605 flows toward second-stage transistor 604. As resistance is increased, less current flows from first power source 605 to second-stage transistor. Power from second power source 606 then drives load 607. In this way, users may adjust the amount of current that must flow from first-stage transistor 602 to second-stage transistor 604, before second-stage transistor 604 is turned on and drives load 607.

Figure 6B:
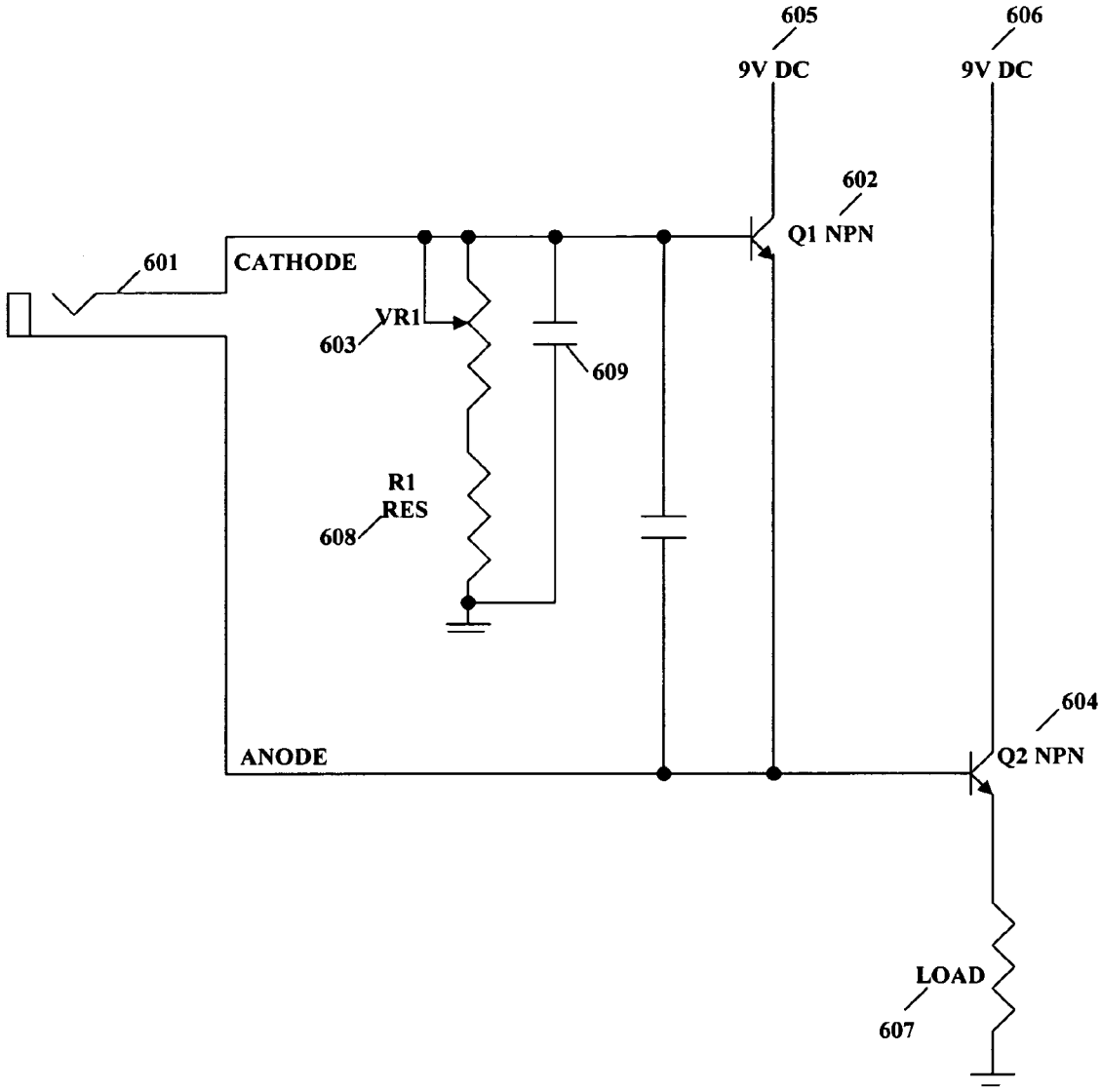
FIG. 6B is a circuit diagram illustrating the preferred embodiment of the switching mechanism shown if FIGS. 1A and 1B.

FIG. 6B is a circuit diagram illustrating a preferred embodiment of a switching mechanism having variable sensitivity, in accordance with the current invention. This embodiment utilizes two cascaded NPN transistors, a capacitor, and a potentiometer for allowing a user to select the sensitivity of the switching mechanism. By connecting a detector with an input jack 601, the cathode of the detector is connected with the base of a first-stage NPN transistor (Q1) 602 and the anode with the emitter of the first-stage NPN transistor (Q1) 602.

In the path between the cathode and the first-stage transistor 602 is a circuit containing potentiometer 603 (VR1), resistor 608 and capacitor 609. Transistor 602 will not turn on until capacitor 609 is fully charged. Potentiometer 603 and resistor 608 act to bleed the capacitor 609 (that is, shunts current to ground) if low-level currents are present such that capacitor 609 will not charge, allowing transistor 602 to turn on. Resistor 608 provides a minimum resistance so that the cathode is never grounded out. Steam or humidity will produce a low-level current at the cathode, while direct contact with water or other polar liquid will produce a much higher current. As the resistance at potentiometer 603 is decreased, low-level to even high currents can be bled off or diverted to ground so that capacitor 609 is never charged and transistor 602 will never turn on. If the resistance at potentiometer 603 is sufficiently increased, even low-level currents will not bleed off quickly enough and they can then charge the capacitor 609 and allow transistor 602 to turn on. In this way, a user may control whether momentary currents from the detector, or those caused by low-level liquids, such as steam or humidity, will turn on the first-stage transistor 602.

When the threshold voltage of first-stage transistor 602 is met or exceeded by current from the cathode and anode of the detector, first-stage transistor 602 allows current from a first source 605 to flow to a second-stage transistor (Q2) 604. Once the threshold voltage of second-stage transistor 604 is met or exceeded by current from first power source 605, second-stage transistor 604 allows current to flow from a second power source 606 to drive a load 607, such as one or more circuits of a transmitter or base unit. Note that the first and second power sources, as in FIG. 1, FIG. 5 and FIG. 6A, may refer to the same power source.

Those skilled in the art will appreciate that the switching mechanism of the current invention may be arranged in various combinations of NPN and PNP transistors with input jacks and input terminals, without departing from the scope of the current invention. Additionally, as described herein, components other than transistors and potentiometers, which provide like functionality, may be used in place of the first-stage transistor, second-stage transistor, or potentiometer, or any combination thereof.

Figure 7:
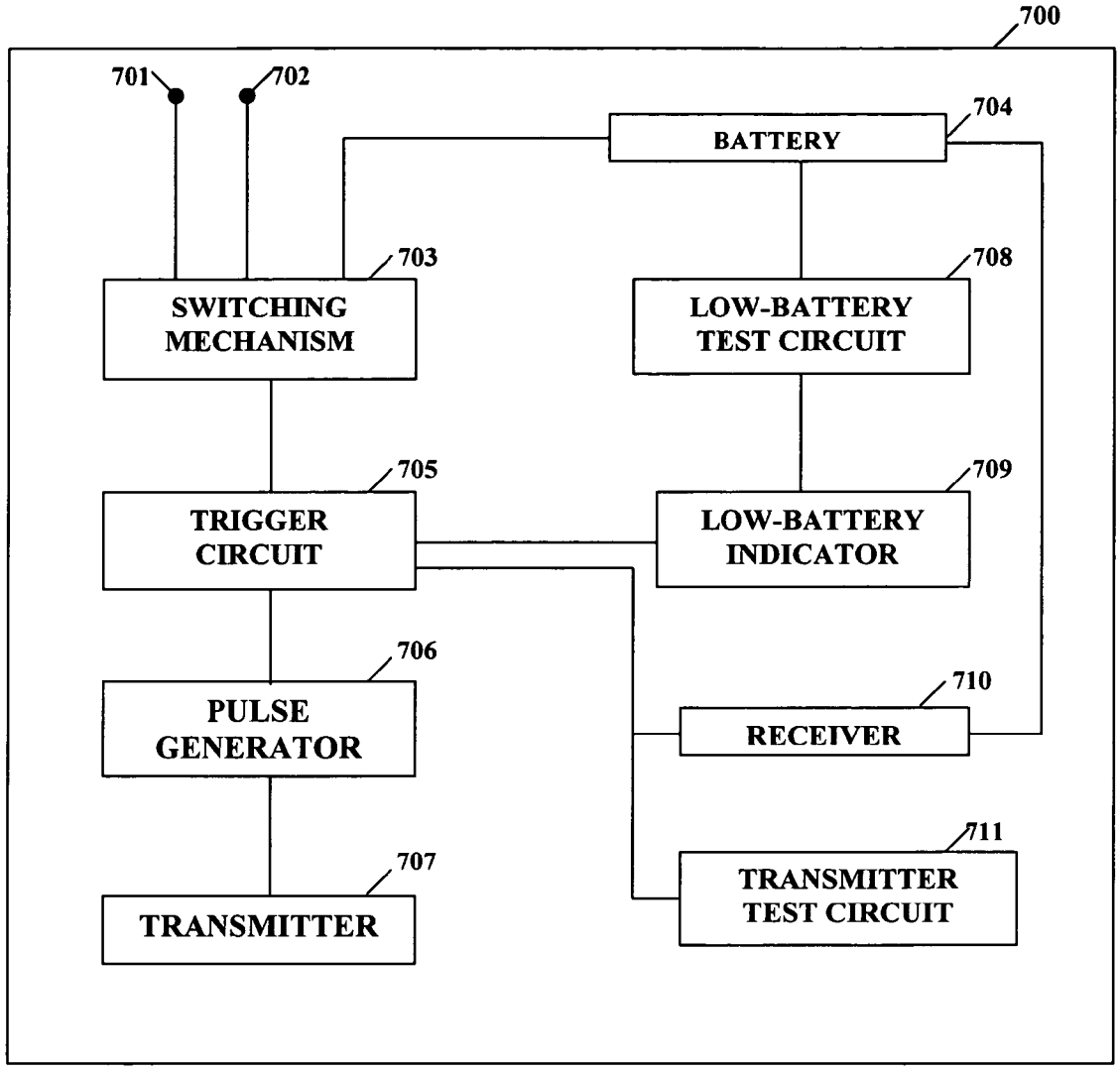
FIG. 7 is a block diagram illustrating components of the remote transmission unit shown in FIG. 1A.

FIG. 7 is a block diagram illustrating components of the remote transmission (R.T.U.) described with reference to FIG. 1A. Those skilled in the art will appreciate that many combinations of circuitry can be used to implement the components described herein. The R.T.U. may comprise a housing 700 made of durable, water-resistant, non-conductive material. Within housing 700 are inputs 701 and 702 for connecting with wiring from a detector, as described herein. This may be accomplished through one or more portals for receiving wiring from the detector, or housing 700 may contain one or more input jacks for connecting with an output jack of the detector, as also described herein.

Inputs 701 and 702 connect with switching mechanism 703. Switching mechanism 703 may be any of the embodiments described herein, or readily apparent variations thereof. When a threshold voltage of switching mechanism 703 is met or exceeded, current from battery 704 flows through it to drive trigger circuit 705. Trigger circuit 705 may comprise a one-shot circuit that supplies current to pulse generator 706 for a limited period. Pulse generator 706 then supplies current intermittently to transmitter 707, which communicates signals to a base unit. Though trigger circuit 705 may be excluded from the R.T.U., it is preferable to use it in order to preserve the life of battery 704 beyond that preserved only by use of pulse generator 706. It should be noted that a transformer may be used in place of battery 704, thus eliminating the need for trigger circuit 705 and pulse generator 706, however, pulse generator 706 could still be used to make sure that transmitter 707 has successfully communicated with its associated receiver.

The R.T.U. may also include a battery test circuit 708 connected with battery 704 and with low battery indicator 709. In one embodiment, battery test circuit 708 periodically attempts to draw current from battery 704. If the voltage supplied by battery 704 falls below a pre-defined threshold, then low-battery indicator 709 is activated. Alternatively, battery test circuit 708 may continually attempt to draw a low volume of current from battery 704, such as 100 microamps or other suitable volume that will not significantly impact life of battery 704. If the voltage to battery test circuit 708 falls below a pre-defined threshold, then low-battery indicator 709 is activated. Low battery indicator 709 may comprise an alarm, LED, flashing indicator light, static indicator light, or any combination of these. If an alarm is used, the alarm may be integrated with the R.T.U. Alternatively, the low battery indicator may supply power to the trigger circuit 705, such that an alarm is triggered at the base unit. In the preferred embodiment of the invention, low battery indicator 709 comprises a flashing light and a low-tone alarm on housing 700. A transformer may be used in the place of battery 704, thus eliminating the need for low-battery test circuit 708 and low-battery indicator 709.

The R.T.U. may also include a receiver 710 for receiving a testing signal from a base unit. When receiver 710 receives a testing signal from a base unit, it supplies current from battery 704 to trigger circuit 705 for a short period of time. This causes a signal to be sent to the base unit, as if a leak were detected. A leak notification means on base unit is then activated for a short time. In this way, users may make sure that the R.T.U. is capable and in range of communicating signals with the base unit, without having to examine the R.T.U. or detector connected with the R.T.U.

The R.T.U. may also include a transmitter test circuit 711, in addition to or in place of receiver 710. When a user activates transmitter test circuit 711, by pressing a button on housing 701, for example, it supplies current to trigger circuit 705 for a short period of time. This causes a signal to be sent to the base unit, as if a leak were detected. A leak notification means on base unit is then activated for a short time. In this way, users may make sure that the R.T.U. is capable and in range of communicating signals with the base unit, without having to examine the R.T.U. or detector connected with the R.T.U.

Figure 8:
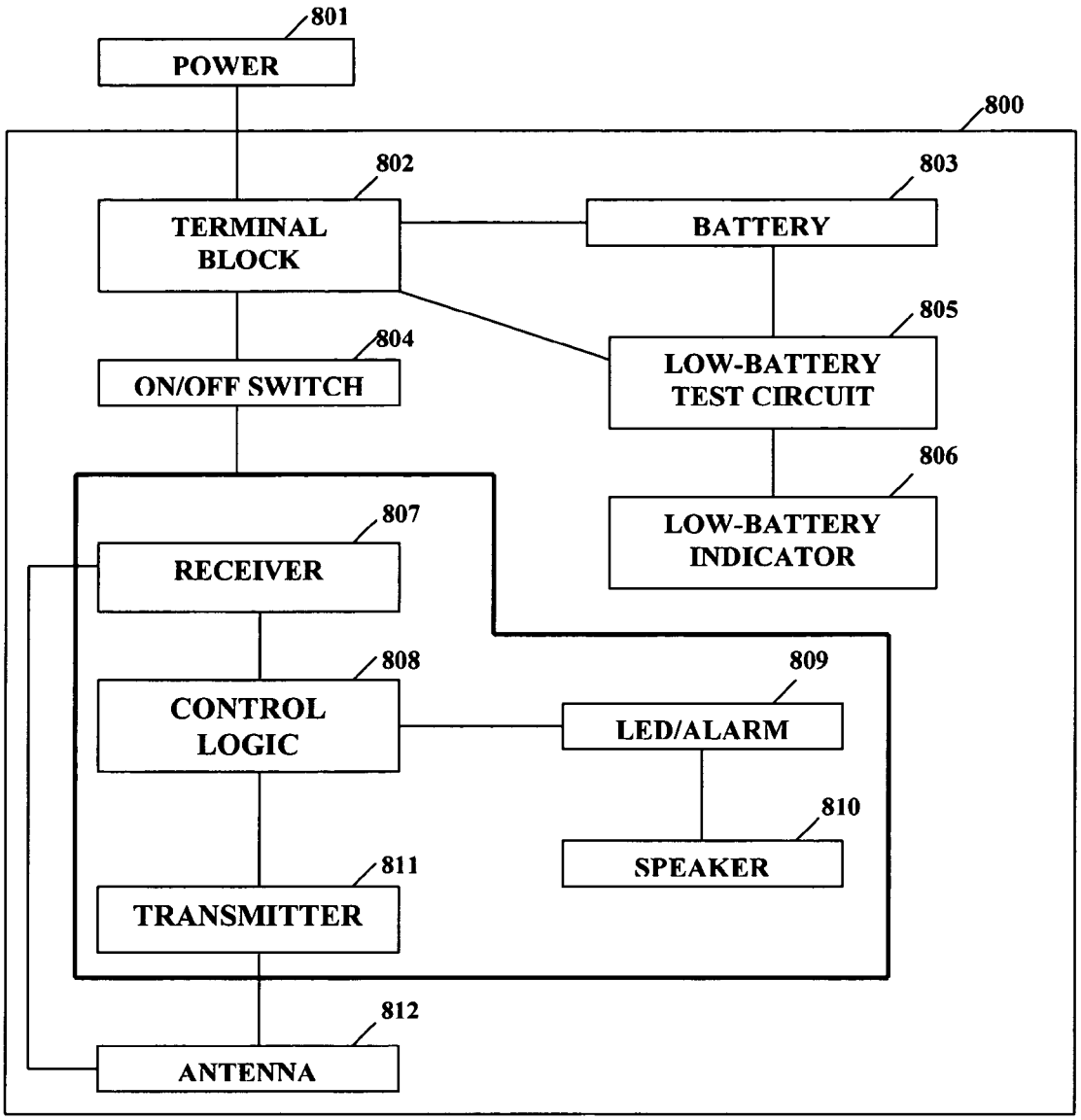
FIG. 8 is a block diagram illustrating components of the base unit shown in FIG. 1A.

FIG. 8 is a block diagram illustrating components of one embodiment of a base unit, as described herein. The base unit comprises a housing 800 of durable, non-conductive material. Housing 800 encompasses a terminal block 802 that is connected with power source 801. Power source 801 may comprise a power transformer that is external to housing 800 and is connected with an electrical outlet. Those skilled in the art will appreciate that the transformer may also be inside housing 800. Terminal block 802 receives power from power source 801 and distributes it to the various components of the base unit that require a power source. Such components may comprise all those described herein, as well as additional power sources that supply power to smaller groups of such components.

Terminal block connects to ON/OFF switch 804, which controls the flow of power from terminal block 802 to the remainder of the base unit. Terminal block 802 is also connected with battery 803 as a back-up power source. Battery 803 is connected with a battery test circuit 805. Battery test circuit 805 may use either battery testing methods described with reference to the R.T.U. in FIG. 7 and activates low-battery indicator 806 when current drawn from battery 803 indicates the voltage has fallen below a pre-defined level. Low battery indicator 806 may comprise an alarm, LED, flashing or static indicator light, or any combination of these. In the preferred embodiment of the invention, low battery indicator 806 comprises a flashing light on housing 800 and a low-tone alarm.

The base unit also comprises a receiver 807 that receives signals via an antenna 812. Preferably, receiver 807 is capable of receiving coded signals, such as those described with reference to FIG. 1, that do not interfere with other remote signals commonly utilized in a home or other building where the base unit is being used. When receiver 807 receives a signal, it signals a control logic module 808, which contains software and/or circuitry for processing the signal and taking pre-defined actions. Control logic module 808 activates indication means 809, which may comprise a visible and/or audible indicator that a leak has been detected. Where indication means 809 comprises an alarm, it may then communicate a signal for the alarm to at least one piezoelectric buzzer or speaker 810. Where indication means 809 comprises a visual indicator, it may comprise an LED of any suitable color and which flashes or stays continually lit when activated.

Control logic module 808 also activates transmitter 811, such that it sends a signal to a remote application control device, as described with reference to FIG. 1A and FIG. 1B. Where the base unit communicates with more than one application control device, the control logic module may also determine whether all such application control devices should be signaled. Transmitter 811 then communicates signals to those application control devices via antenna 812.

Figure 9:
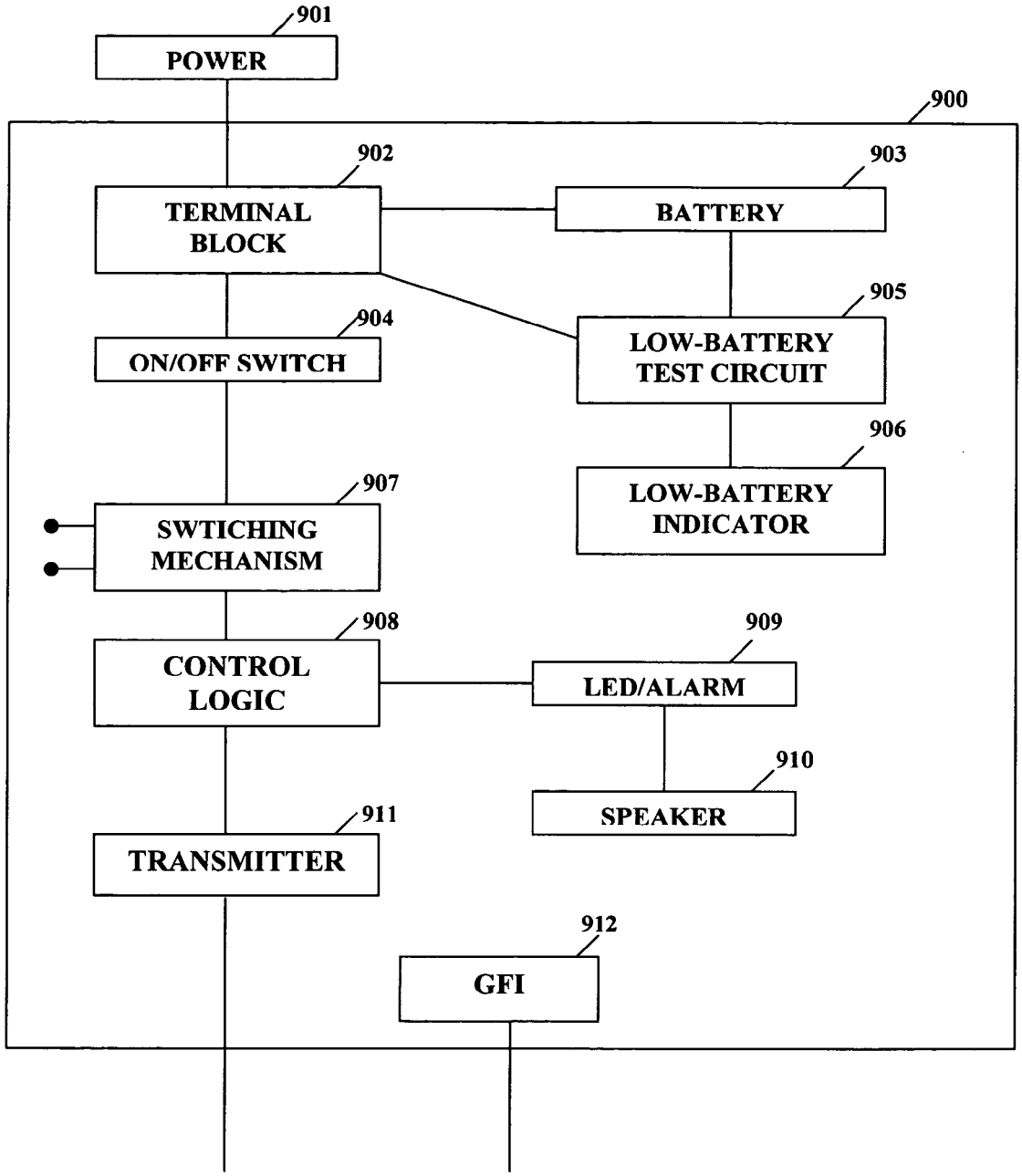
FIG. 9 is a block diagram illustrating components of the base unit shown in FIG. 1B.

FIG. 9 illustrates a second embodiment of the base unit, in accordance with the present invention. The embodiment shown in FIG. 9 illustrates components of a base unit that is directly connected with a detector, in this illustration a leak detector pad, and an application control device or a device to be controlled. In such an embodiment, a receiver is not necessary. Rather, a switching mechanism 907 of any kind described herein, having input terminals or an input jack of those kinds described herein, is in communication with the control logic module 908 and ON/OFF switch 904. When the threshold voltage of the final component in switching mechanism 908 is reached, power flows through it and drives control logic module 908. Control logic module 908 then activates indication means 909 and transmitter 911. Transmitter 911 then sends a signal to a device to which is electrically connected, such as an application control device, an electronic valve, or an appliance.

Where a base unit is hardwired to an appliance that it controls, it may also contain a ground fault interrupter (GFI) 912, for cutting electricity to an appliance that has been turned off or to which water has been shut off. The purpose of GFI 912 is to prevent shock from appliances in standing water. Circuitry suitable for implementing GFI 912 is readily known to those skilled in the art.

Those skilled in the art will appreciate that several combinations of the above embodiments of the base unit may be arranged, without departing from the scope of the invention. Examples include a base unit that communicates remotely with a R.T.U. but is hard wired to devices that it controls, as well as a base unit that is hard wired to a detector but communicates remotely with devices that it controls.

Figure 10:
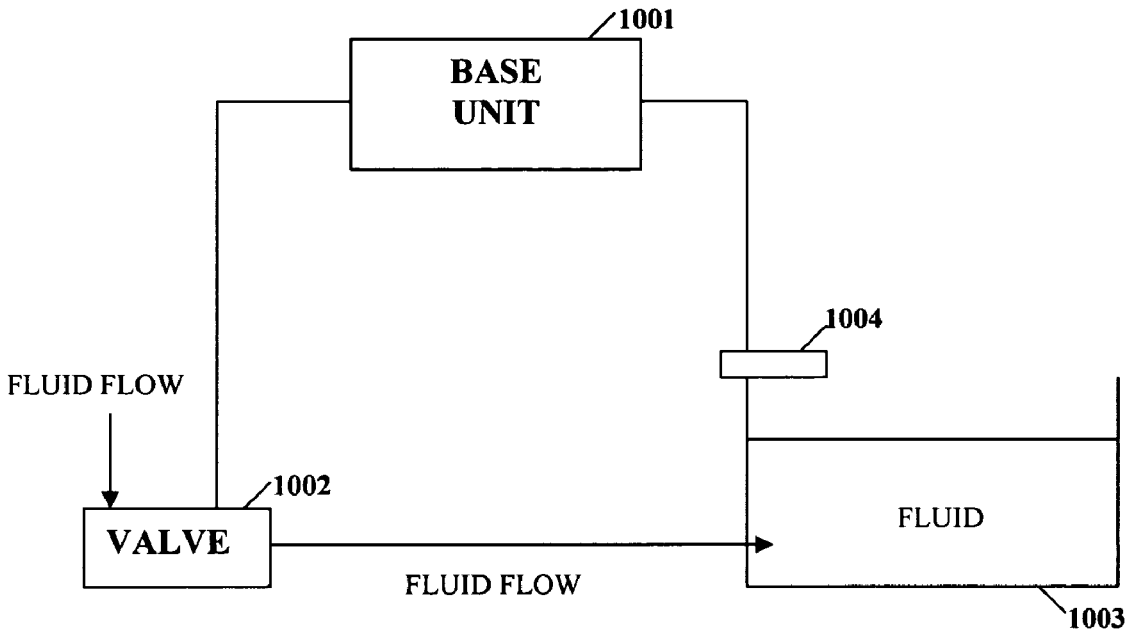
FIG. 10 is a pictorial diagram illustrating a float indicator application of the current invention.

In addition to detecting leaks and shutting off fluid flow to source of leaks, as described herein, the current invention is also susceptible of other uses. One such use is as a float indicator, as illustrated in FIG. 10. In FIG. 10, a detector pad 1004 is placed at the rim or at a fill line of a tank 1003. When fluid fills tank 1003, it contacts detector pad 1003. This completes the galvanic cell and supplies a voltage to a switching mechanism in base unit 1001, to which detector pad may be directly connected. Base unit 1001 then communicates a signal to an electronically-activated valve 1002 that controls fluid flow to tank 1003. The valve closes, preventing overflow of tank 1003. When the fluid in tank 1003 passes below the fill line, valve 1002 may pass to its open state and fill tank 1003 back to its desired capacity.

The embodiments and figures described above are for example purposes only and are not intended to limit the scope of the invention. Those skilled in the art will recognize that many variations upon the current invention may be made without departing from its scope. For instance, where a single valve controls fluid flow to more than one location, multiple detectors may be placed in parallel and may be used in conjunction with a single base unit and/or transmitter. The devices can also be integrated into any appliance that uses water.

What is claimed is:

1. A system for detecting an undesirable condition and manipulating at least one electronic device, the system comprising:

at least one liquid detector, each liquid detector comprising a cathode and an anode that are adapted to form a galvanic cell when the cathode and the anode both contact a polar liquid;

a switching mechanism electrically coupled to the at least one liquid detector, wherein the switching mechanism (i) is adapted to receive a positive voltage from the galvanic cell formed from the cathode and anode of the liquid detector, and (ii) comprises at least one switching component electrically coupled to at least one power source, the at least one power source to flow through the at least one switching component when the positive voltage is sufficient to activate the at least one switching component.

2. The system of claim 1, wherein each switching component comprises a transistor, a voltage comparator, an operational amplifier, a thyristor, or a field-effect transistor.

3. The system of claim 1, further comprising a gas detector comprising a gas detection means and a power source adapted to activate the at least one switching component, when a pre-defined quantity of gas is detected.

4. The system of claim 1, further comprising a temperature detector comprising a thermocouple and a power source adapted to activate the at least one switching component, when a pre-defined temperature is detected.

5. The system of claim 1, further comprising a base unit communicating with the switching mechanism;

at least one application control device, each application control device communicating with the base unit;

each application control device electrically couple to at least one electronic control apparatus adapted to prevent the undesirable condition;

at least one notification control device, each notification control device communicating with the base unit; and each notification control device electrically coupled to an electronic notification apparatus adapted to notify a user that the undesirable condition has been detected.

6. The system of claim 5, wherein the switching mechanism is electrically connected with the base unit.

7. The system of claim 5, wherein the base unit communicates with the switching mechanism via a remote transmission unit, the remote transmission unit comprising:

a housing;

the switching mechanism;

at least one input adapted to electrically couple the at least one liquid detector to the switching mechanism;

a transmitter electrically coupled to the switching mechanism; and wherein the transmitter is adapted to send a signal to the base unit upon receiving electrical current from the switching mechanism.

8. The system of claim 7, wherein the signal comprises a rolling code signal, a billion code signal, a 9-pin DIP code signal, or a 12-pin DIP code signal.

9. The system of claim 7, wherein the remote transmission unit further comprises battery test circuit adapted to test the at least one power source.

10. The system of claim 5, wherein the electronic control apparatus comprises an electronic valve.

11. The system of claim 5, wherein the electronic control apparatus comprises an appliance's ON/OFF switch.

12. The system of claim 11 where the appliance's ON/OFF switch further comprises a Ground Fault Interrupter (GFI) circuit.

13. The system of claim 5, wherein the notification control device comprises an autodialer adapted to communicate with the base unit, and wherein the electronic notification apparatus comprises a telephone adapted to communicate with a remote agent.

14. The system of claim 5, wherein the electronic notification apparatus comprises a personal computer or a handheld computing device electrically coupled to the notification control device; and the notification control device is adapted to instruct the electronic notification apparatus to transmit a text message to a remote agent, when the notification control device receives a signal from the base unit.

15. The system of claim 5, wherein the electronic notification apparatus is integrated with the base unit and comprises at least one apparatus selected from a group consisting of a light, a light-emitting diode, and an alarm.

16. The system of claim 1, wherein each switching component is adapted to be activated, when the switching component receives a voltage that exceeds a threshold voltage of the switching component.

17. The system of claim 16, wherein the threshold voltage is zero volts.

18. The system of claim 16, wherein the threshold voltage is greater than zero volts.

19. A system for detecting an undesirable condition and manipulating at least one electronic device, the system comprising:

at least one liquid detector, each liquid detector comprising a cathode and an anode that are adapted to form a galvanic cell when the cathode and the anode both contact a polar liquid;

a switching mechanism electrically coupled to the at least one liquid detector, wherein the switching mechanism (i) is adapted to receive a positive voltage from the galvanic cell formed from the cathode and anode of the liquid detector, (ii) comprises at least one switching component adapted to allow electrical current from at least one power source to flow through the at least one switching component when the positive voltage is sufficient to activate the at least one switching component, and (iii) comprises a mechanism adapted to adjust a sensitivity of the switching mechanism.

20. The system of claim 19, wherein:

the at least one switching component includes:

a first-stage switching component having a first threshold voltage, the first-stage switching component electrically coupled to a first power source; and a second-stage switching component having a second threshold voltage, the second-stage switching component electrically coupled to a second power source;

wherein the first-stage switching component is adapted to allow electrical current from the first power source to flow to the second-stage switching component, when the positive voltage meets or exceeds the first threshold voltage, and wherein the second-stage switching component is adapted to allow electrical current from the second power source to drive a load when a voltage corresponding to the electrical current received from the first power source meets or exceeds the second threshold voltage; and the mechanism to adjust the sensitivity of the switching mechanism comprises a variable resistor electrically coupled to the first-stage switching component, the second-stage switching component, or a combination thereof.

21. The system of claim 19, wherein the at least one switching component includes:

a first-stage switching component having a first threshold voltage, the first-stage switching component electrically coupled to a first power source and to a first input jack;

a second-stage switching component having a second threshold voltage different from the first threshold voltage, the second-stage switching component electrically coupled to a second power source and to a second input jack;

wherein the first-stage switching component is adapted to (i) receive the positive voltage when the liquid detector whose cathode and anode have formed a galvanic cell is coupled to the first input jack, and (ii) allow a first electrical current from the first power source to flow to the second-stage switching component when the positive voltage meets or exceeds the first threshold voltage; and wherein the second-stage switching component is adapted to (i) allow a second electrical current from the second power source to drive a load, when the first electrical current received from the first power source meets or exceeds the second threshold voltage, and (ii) receive the positive voltage when the liquid detector whose cathode and anode have formed a galvanic cell is coupled to the second input jack, and allow a second electrical current from the second power source to drive a load when the positive voltage meets or exceeds the second threshold voltage.

* * * * *